US006981476B2

(12) United States Patent
Saretto et al.

(10) Patent No.: US 6,981,476 B2
(45) Date of Patent: Jan. 3, 2006

(54) INTERNAL COMBUSTION ENGINE WITH A SINGLE CAMSHAFT WHICH CONTROLS EXHAUST VALVES MECHANICALLY AND INTAKE VALVES THROUGH AN ELECTRONICALLY CONTROLLED HYDRAULIC DEVICE

(75) Inventors: Roberto Saretto, Orbassano (IT); Costantinos Vafidis, Orbassano (IT); Francesco Vattaneo, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 11/014,941

(22) Filed: Dec. 20, 2004

(65) Prior Publication Data

US 2005/0155566 A1 Jul. 21, 2005

(30) Foreign Application Priority Data

Jan. 16, 2004 (EP) ..... 04425023

(51) Int. Cl.
*F01L 1/34* (2006.01)

(52) U.S. Cl. ..... 123/90.16; 123/90.12; 123/90.15; 123/90.17; 123/90.48; 123/90.44; 123/90.55

(58) Field of Classification Search ..... 123/90.16, 123/90.12
See application file for complete search history.

(56) References Cited

U.S. PATENT DOCUMENTS

| | | | | |
|---|---|---|---|---|
| 4,796,573 | A | 1/1989 | Wakeman et al. | |
| 4,887,562 | A | 12/1989 | Wakeman | |
| 5,839,400 | A * | 11/1998 | Vattaneo et al. | 123/90.16 |
| 6,082,318 | A * | 7/2000 | Malatto et al. | 123/193.5 |
| 6,138,621 | A * | 10/2000 | Albanello et al. | 123/90.12 |
| 6,227,154 | B1 * | 5/2001 | Wakeman | 123/90.16 |
| 6,237,551 | B1 | 5/2001 | Macor et al. | |
| 6,325,028 | B1 * | 12/2001 | Albanello et al. | 123/90.12 |
| 6,553,950 | B2 * | 4/2003 | Chiappini et al. | 123/90.12 |
| 6,918,364 | B2 * | 7/2005 | Vattaneo et al. | 123/90.55 |

FOREIGN PATENT DOCUMENTS

| | | |
|---|---|---|
| EP | 0 803 642 A | 10/1997 |
| EP | 0 894 956 A | 2/1999 |
| EP | 1 245 799 A | 10/2002 |
| EP | 1 375 843 A | 1/2004 |

* cited by examiner

*Primary Examiner*—Thomas Denion
*Assistant Examiner*—Kyle M. Riddle
(74) *Attorney, Agent, or Firm*—Sughrue Mion, PLLC

(57) ABSTRACT

A multiple cylinder engine is described, provided with an electronically controlled hydraulic system for actuating the intake valves, in which intake valves and exhaust valves are controlled by a single camshaft.

16 Claims, 10 Drawing Sheets

INTERNAL COMBUSTION ENGINE WITH A SINGLE CAMSHAFT WHICH CONTROLS EXHAUST VALVES MECHANICALLY AND INTAKE VALVES THROUGH AN ELECTRONICALLY CONTROLLED HYDRAULIC DEVICE

SUMMARY OF THE INVENTION

The present invention relates to internal combustion engines with multiple cylinders, of the type comprising:

at least one intake valve and at least one exhaust valve for each cylinder, each provided with respective spring return means which bias the valve towards a closed position, to control respective intake and exhaust conduits, at least one camshaft, to actuate the intake and exhaust valves of the engine cylinders by means of respective tappets, in which each intake valve is actuated by the respective tappet, against the action of the aforesaid spring return means, by the interposition of hydraulic means including a pressurized fluid chamber, into which projects a pumping piston connected to the tappet of the intake valve, said pressurized fluid chamber being able to be connected by means of a solenoid valve with an exhaust channel, in order to uncouple the intake valve from the respective tappet and cause the rapid closure of the valve by effect of the respective spring return means, electronic control means for controlling each solenoid valve in such a way as to vary the time and travel of opening of the respective intake valve as a function of one or more operative parameters of the engine.

Engines of the type specified above have been described and illustrated in various prior patents by the same Applicant. By way of example, see European Patent Application EP 1 344 900 A2.

In his European Patent Application EP 0 894 956 A2, the applicant has disclosed an engine of the above indicated type having the features indicated in the pre-characterizing portion of claim 1.

An object of the invention is to provide an engine having the characteristics set out above, having an extremely simple structure with reduced bulk. An additional object is to provide an engine of the type specified above which is characterized by high levels of efficiency and reliability.

In view of achieving these and other objects, the invention relates to an engine as defined in the accompanying claim 1. Additional preferred and advantageous characteristics of the invention are specified in the dependent claims.

BRIEF DESCRIPTION OF THE DRAWINGS

The invention shall now be described with reference to the accompanying drawings, provided purely by way of non limiting example, in which.

DETAILED DESCRIPTION OF THE INVENTION

Figure 1:
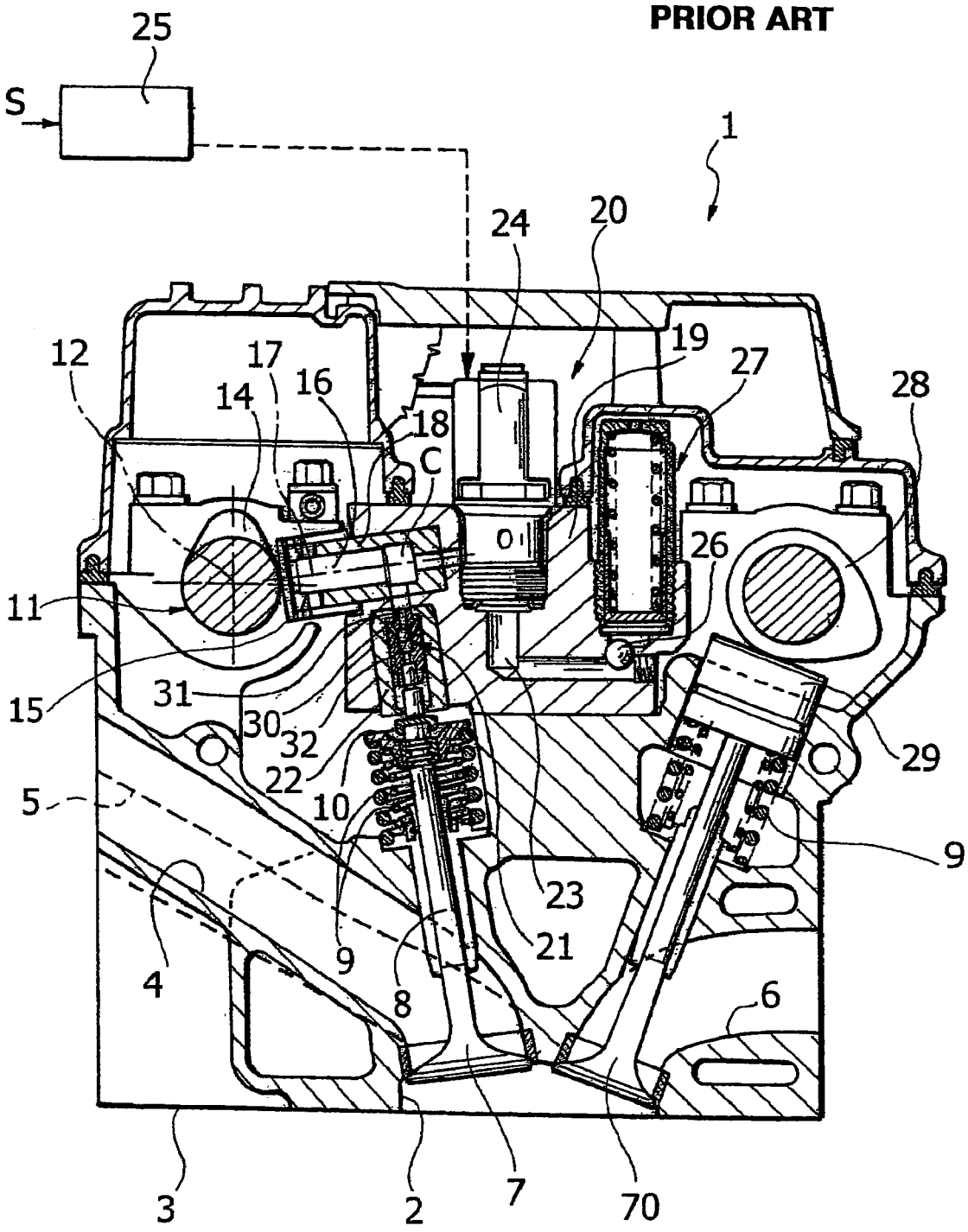
FIG. 1 is a section view of an engine according to the prior art, of the type described in European patent EP 0 803 642 B1 by the same Applicant.

With reference to FIG. 1, the internal combustion engine described in European patent EP 0 803 642 B1 by the same Applicant is a multi-cylinder engine, for instance an engine with four cylinders in line, comprising a cylinder head 1. The head 1 comprises, for each cylinder, a cavity 2 formed by the base surface 3 of the head 1, defining the combustion chamber, into which end two intake conduits 4, 5 and two exhaust conduits 6. The communication of the two intake conduits 4, 5 with the combustion chamber 2 is controlled by two intake valve 7, of the traditional mushroom type, each comprising a stem 8 slidably mounted in the body of the head 1. Each valve 7 is returned towards the closed position by springs 9 interposed between an inner surface of the head 1 and an end cup 10 of the valve. The communication of the two exhaust conduits 6 with the combustion chamber is controlled by two valves 70, also of a traditional type, whereto are associated springs 9 for the return towards the closed position. The opening of each intake valve 7 is controlled, in the manner described below, by a camshaft 11 rotatably mounted around an axis 12 within supports of the head 1, and comprising a plurality of cams 14 for actuating the intake valves 7.

Each cam 14 which controls an intake valve 7 co-operates with the washer 15 of a tappet 16 slidably mounted along an axis 17 which, in case of the example illustrated in the aforementioned prior document, is directed substantially at 90° relative to the axis of the valve 7. The washer 15 is returned against the cam 14 by a spring associated thereto. The tappet 16 constitutes a pumping piston slidably mounted within a bushing 18 borne by a body 19 of a pre-assembled set 20, incorporating all the electrical and hydraulic devices associated with the actuation of the intake valves, as described in detail hereafter. The pumping piston 16 is able to transmit a thrust to the stem 8 of the valve 7, in such a way as to cause the opening thereof against the action of the spring means 9, by means of pressurized fluid (preferably oil from the engine lubrication loop) present in a pressure chamber C into which projects the pumping piston 16, and by means of a piston 21 mounted slidably in a cylindrical body constituted by a bushing 22 which is also borne by the body 19 of the subgroup 20. In the known solution shown in FIG. 1, the pressurized fluid chamber C associated to each intake valve 7 can be placed in communication with an exhaust channel 23 by means of a solenoid valve 24. The solenoid valve 24, which can be of any known type, suited to the function illustrated herein, is controlled by electronic control means, schematically designated by the number 25, according to signals S indicative of engine operating parameters, such as the position of the accelerator pedal and the number of engine revolutions per minute. When the solenoid valve 24 is open, the chamber C comes in communication with the channel 23, so the pressurized fluid present in the chamber C flows into said channel and an uncoupling is obtained of the cam 14 and of the respective tappet 16 from the intake valve 7, which then rapidly returns to its closed position under the action of the return springs 9. By controlling communication between the chamber C and the exhaust channel 23, it is therefore possible to vary at will the time and stroke of the opening of each intake valve 7.

The exhaust channels 23 of the various solenoid valves 24 all end in a same longitudinal channel 26 communicating with pressure accumulators 27, only one of which is visible in FIG. 1.

All the tappets 16 with the associated bushings 18, the pistons 21 with the associated bushings 22, the solenoid valves 24 and the related channels 23, 26 are borne and formed from the aforesaid body 19 of the pre-assembled set 20, to the advantage of the rapidity and ease of assembly of the engine.

The exhaust valves 70 associated to each cylinder are controlled, in the embodiment illustrated in FIG. 1, in traditional fashion, by a respective cam shaft 28, by means of respective tappets 29, although in principle, in the case of the prior document mentioned above, an application of the hydraulic actuation system to command the exhaust valves is not excluded.

With reference to FIG. 1, the variable volume chamber defined inside the bushing 22 and facing the piston 21 (which in FIG. 1 is shown in its minimum volume condition, the piston 21 being in its upper top stroke end position) communicates with the pressurized fluid chamber C through an opening 30 obtained in an end wall of the bushing 22. Said opening 30 is engaged by an end nose 31 of the piston 21 in such a way as to obtain a hydraulic braking of the motion of the valve 7 in the closing phase, when the valve is near the closed position, since the oil present in the variable volume chamber is forced to flow into the pressurized fluid chamber C passing through the play existing between the end nose 31 and the wall of the opening 30 engaged thereby. In addition to the communication constituted by the opening 30, the pressurized fluid chamber C and the variable volume chamber of the piston 21 communicate with other by means of internal passages formed in the body of the piston 21 and controlled by a check valve 32 which allows the passage of fluid only from the pressurized chamber C to the variable volume chamber of the piston 21.

During the normal operation of the prior art engine illustrated in FIG. 1, when the solenoid valve 24 excludes the communication of the pressurized fluid chamber C with the exhaust channel 23, the oil present in this chamber transmits the motion of the pumping piston 16, imparted by the cam 14, to the piston 21 that commands the opening of the valve 7. In the initial phase of the opening movement of the valve, the fluid coming from the chamber C reaches the variable volume chamber of the piston 21 passing through the check valve 32 and additional passages which place in communication the inner cavity of the piston 21, which has tubular shape, with the variable volume chamber. After a first displacement of the piston 21, the nose 31 comes out of the opening 30, so the fluid coming from the chamber C can pass directly into the variable volume chamber through the opening 30, which is now free.

In the inverse movement of closure of the valve, as stated, during the final phase the nose enters into the opening 30 causing the hydraulic braking of the valve, to prevent any impacts of the body of the valve against its seat, for instance subsequently to an opening of the solenoid valve 24 which causes the immediate return of the valve 7 to the closed position.

As an alternative to the hydraulic braking device illustrated in FIG. 1, the Applicant has also already proposed (see European patent application EP 1 344 900 A2) an alternative solution in which the piston 21 actuating the engine intake valve lacks the end nose and the check valve 32 instead of being formed in the body of the piston 21, is formed in a fixed part. Moreover, in the wall of the bushing within which is slidably mounted the piston 21 end one or more passages, directly communicating with the pressure chamber C. Said passages are shaped in positioned in such a way that they are progressively shut by the piston 21 in the final closure phase of the engine valve, to achieve a narrowing of the fluid passage section, with the consequent hydraulic braking effect. In the solution proposed in the European patent application EP 1 344 900 A2, moreover, between the piston 21 which actuates the engine valve and the stem of the engine valve is interposed an auxiliary hydraulic tappet.

The first embodiment of the invention, illustrated in FIGS. 2–4, shall now be described. In these figures, the parts corresponding to those of the known solution illustrated in FIG. 1 are designated by the same reference number.

Figure 2:
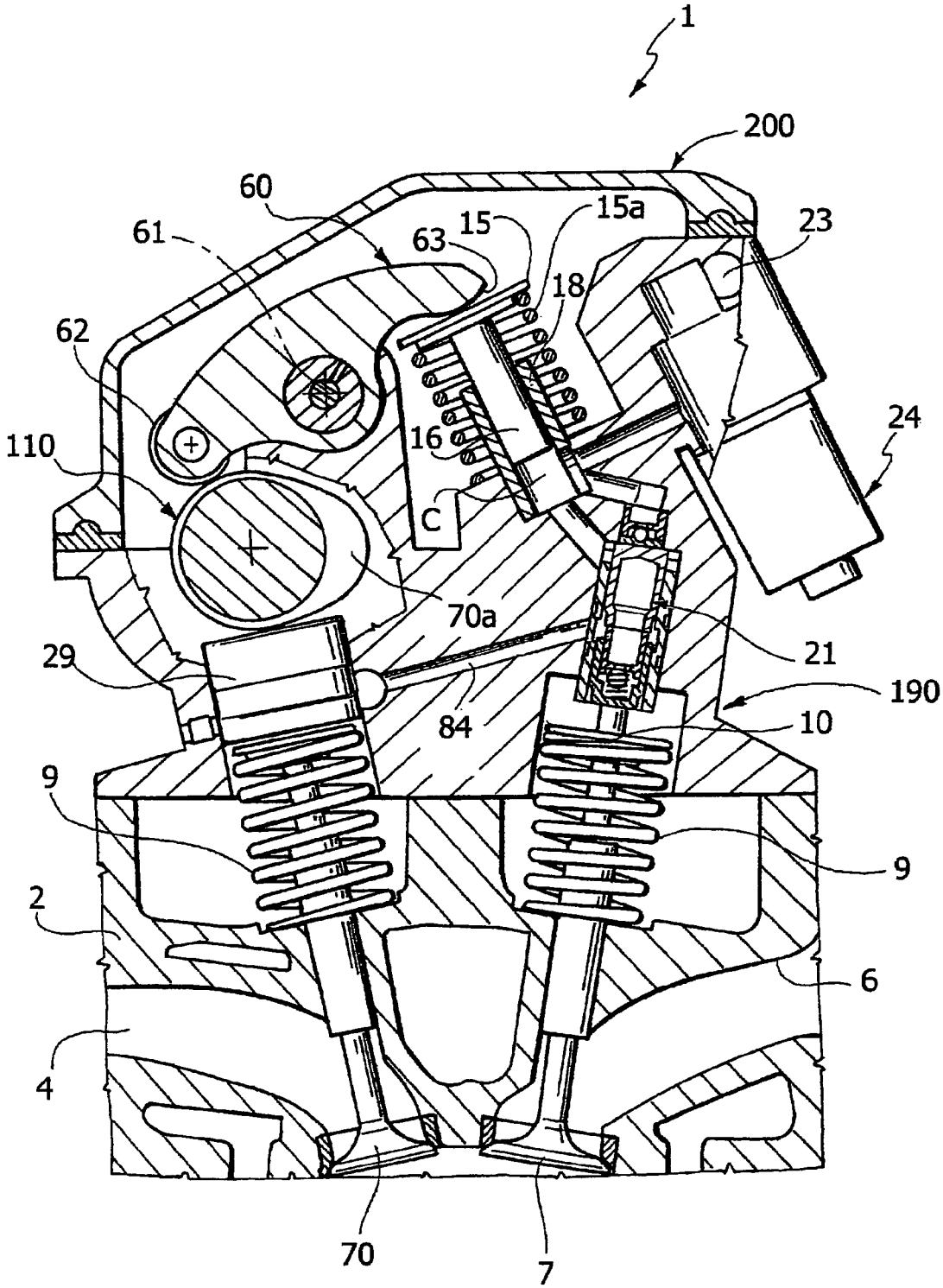
FIG. 2 shows a first embodiment of the invention, applied to a gasoline engine.
Figure 3:
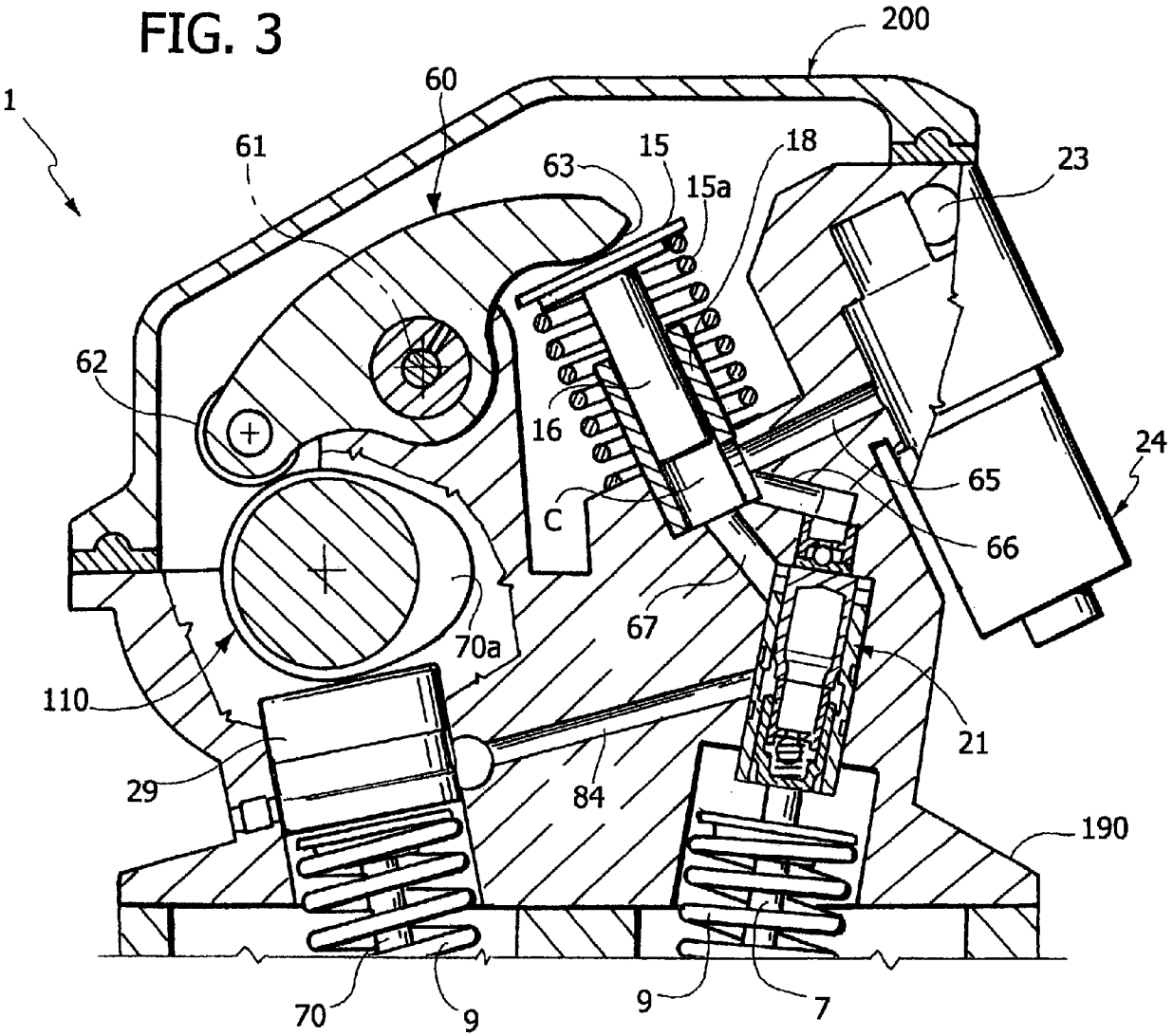
FIG. 3 is an enlarged view of a detail of FIG. 2.
Figure 4:
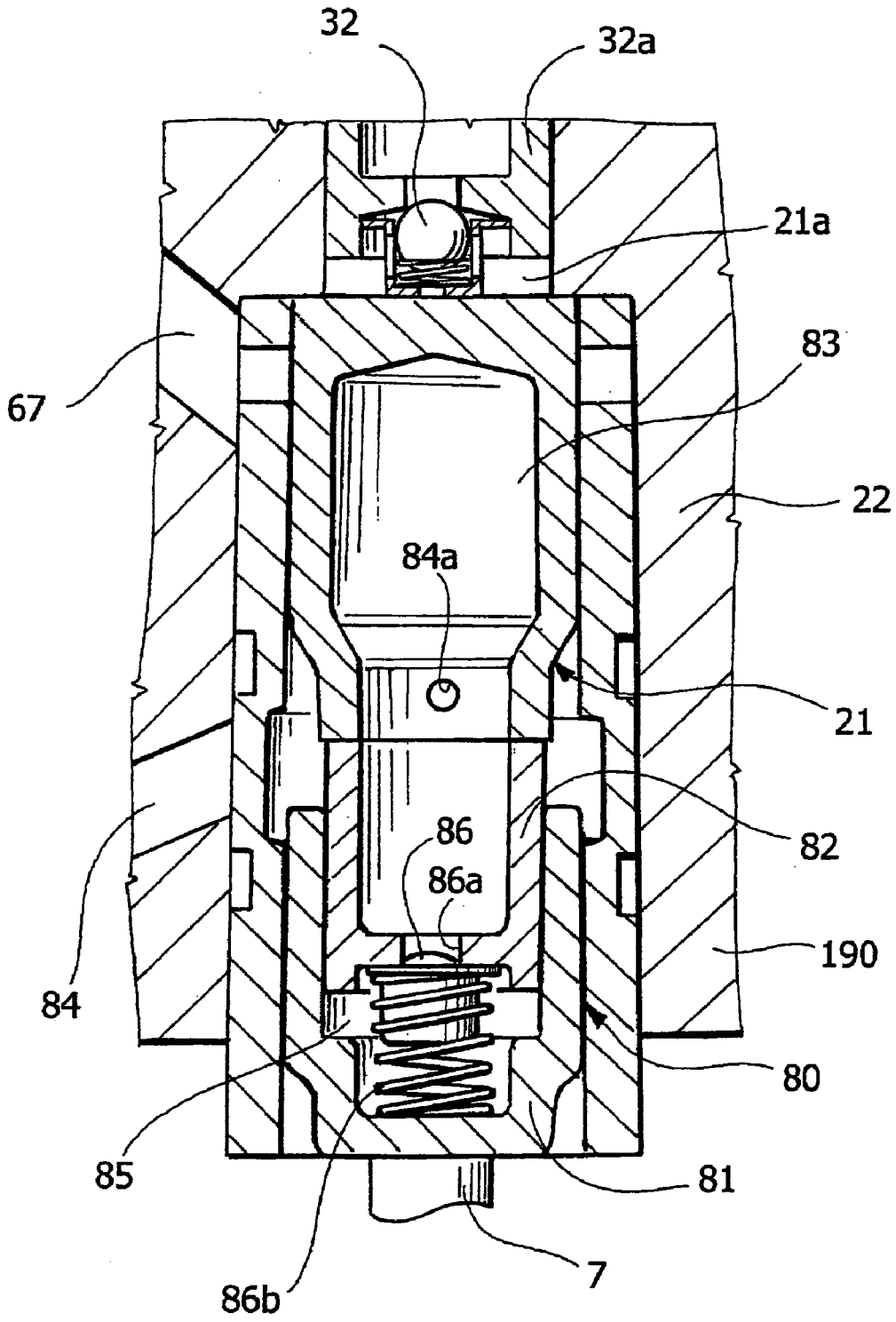
FIG. 4 is an even more enlarged view of a detail of FIG. 3.

A first fundamental difference of the solutions illustrated in FIGS. 2-4 relative to the one in FIG. 1 resides in the fact that in the latter both the intake valves 7 and the exhaust valves 70 of the engine are controlled by a single camshaft 110. The camshaft 110 bears a plurality of cams distributed along its length, some of which, designated by reference 7*a*, individually control the opening a respective intake valve 7, whilst the remaining ones, designated by the reference 70*a*, individually control the opening of a respective exhaust valve 70. The cams 70*a* controlling the exhaust valves 70 actuate said exhaust valves mechanically, in the conventional manner. In the example illustrated in FIGS. 2–4, each cam 70*a* is in direct contact with a tappet 29 which actuates the opening of a respective exhaust valve 70 against the action of the spring means 9. Each cam 7*a*, instead, actuates the respective intake valve 7 by means of an electronically controlled hydraulic device of the type described above with reference to FIG. 1. However, each cam 7*a* is not in direct contact with the washer 15 of the pumping piston 16, but instead actuates said washer, against the action of a spring 15a, by means of a rocker arm member 60. In the example illustrated in FIGS. 2–4, the rocker arm members 60 associated to the intake valves 7 are all borne by a shaft mounted oscillating around its axis 61 on the structure of the engine. Each rocker arm member 60 has an end bearing a freely rotating roller 62, which is in contact with the respective cam 7*a* of the camshaft 110, whilst the other end 63 of the rocker arm member 60 co-operates with the washer 15. The fact that the element co-operating with the cam 7*a* is a roller is advantageous, because it avoids the risk, which instead arose in the known solution of FIG. 1, that the cam may transmit by friction transverse thrusts which may cause an inclination of the pumping piston 16 relative to its theoretical axis, with consequent difficulties in sliding.

The pumping piston 16 controls the opening of the intake valve 7 by means of the electronically controlled hydraulic device.

An additional difference of the invention with respect to the prior art solution described above resides in the fact that over the head 2 is mounted a block 190 whereon are borne not only all the elements and parts of the electronically controlled hydraulic device, as in FIG. 1, but also the supports within which the camshaft 110 is rotatably mounted, as well as the supports for the rocker arm members 60.

Yet another important characteristic of the invention resides in the fact that each of the solenoid valves 24 associated to the hydraulic means for controlling the engine intake valve is mounted "dry", outside the block 190, i.e. each solenoid valve 24 is inserted in a seat obtained in the block 190 and is not exposed to the lubricated environment, defined between the block 190 and a lid 200, in which are instead contained the camshaft 110, the rocker arm members 60 and the guide bushings of the pumping pistons 16. This arrangement is advantageous, since the solenoid valves are thereby cooled by the air and are not directly exposed to the overheating caused by the hydraulic device in its operation.

The whole structure constituted by the block 190 and by the various parts mounted thereon can be pre-assembled before the final mounting on the head 2 of the engine.

With reference to the electronic hydraulic device which actuates the opening of each intake valve 7, said device, in accordance with the prior art solution, has a pressure chamber C facing the pumping piston 16, which communicates with a channel 65 that can be placed in communication with an exhaust channel 23 through the respective solenoid valve 24. When the solenoid valve 24 is closed the motion of the rocker arm member 60 actuated by a cam 7*a*, corresponding to a determined intake valve 7, determines the motion of the pumping piston 16, against the action of the spring return means 15*a*. The motion of the pumping piston 16 causes a passage of pressurized fluid from the chamber C to the variable volume chamber (designated by the reference 21*a* in FIG. 4) which faces the piston 21 actuating the intake valve 7.

As in the prior art solution, the piston 21 is slidably mounted in a bushing 22, which is mounted within the block 190.

At the side opposite the chamber 21*a*, the piston 21*a* has an end (the lower end in FIGS. 2–4) which actuates (through an auxiliary hydraulic tappet 80, described below) the stem of valve 7. FIGS. 3, 4 show the piston 21 in its maximum raised position, corresponding to the closed condition of the intake valve 7. In this condition, the variable volume chamber 21*a* facing the piston 21 is at its minimum volume and communicates with the pressure chamber C through a conduit 66 formed in the body 190 and a check valve 32, borne by a fixed body 32*a* (see FIG. 4), which allows only the passage of fluid from the pressure chamber C to the variable volume chamber 21*a* facing the piston 21.

In the case of the solution illustrated in FIGS. 2, 3, the check valve 32, similarly to what is already proposed in the European patent application EP 1 344 900 A2 is borne by a body 32*a* which is fixed relative to the block 190. When the piston 21 is sufficiently far away from its end position corresponding to the closed condition of the valve 7, the variable volume chamber 21*a* facing the piston 21 communicates with the pressure chamber C through an additional conduit 67 and through one or more passages (not shown in the figures) obtained in the wall of the bushing 22, similarly to what is illustrated in EP 1 344 900 A2.

As described above with reference to prior art solutions, in operation, assuming that the solenoid valve 24 is closed and that the intake valve 7 is closed, a rotation of the camshaft 110 causes an oscillation of the rocker arm member 60 and a consequent actuation of the pumping piston 16. The lower of the piston 16 (with reference to FIGS. 2–4) causes a passage of fluid from the pressure chamber C to the variable volume chamber 21*a* facing the piston 21. The latter thus moves downwards (with reference to FIGS. 2–4) causing the opening of the valve 7. In the first phase of the opening motion, the fluid passes only from the chamber C through the passage 66 and the check valve 32. When the piston 21 has moved a sufficient distance away from its initial position, it frees the openings obtained in the bushing 22 communicating with the passage 67, so a greater quantity of fluid can pass from the chamber C to the chamber of the piston 21. During the closing motion of the intake valve 7, the fluid which is thrust by the piston 21 outside the variable volume chamber 21*a* returns into the pressure chamber C. This passage cannot take place through the check valve 32, but only through the openings communicating with the passage 67. Said openings are shaped and arranged for example according to the teachings of EP 1 344 900 A2, in order progressively to reduce the fluid passage section in the terminal closing phase of the valve, to obtain a hydraulic braking effect of the valve.

Naturally, in accordance with prior art solutions, the solenoid valve 24 is controlled by an electronic control unit 25 (similar to the one shown in FIG. 1) on the basis of signals S indicating the operating parameters of the engine, to vary the time and amplitude of the opening of the intake valve during the operation of the engine, independently of the profile of the cam 7*a*. Every time the solenoid valve 24 is opened, the pressure chamber C is emptied and the intake valve 7 closes rapidly, under the action of the respective return springs 9, any violent impact of the valve within its seat being in any case prevented by the hydraulic brake effect obtained with the device described above. Also in accordance with EP 1 344 900 A2, to prevent an excessive hydraulic braking effect when the fluid (which is the engine lubricating oil) is too viscous, for instance when starting the engine under low temperature conditions, an additional calibrated hole can be provided which places in communication the variable volume chamber of the piston 21 with the pressure chamber C.

An important advantage of the invention described above is that, combining the use of a single camshaft to control both the intake and the exhaust valves, with an electronically controlled hydraulic command to control the intake valves, and providing the rocker arm members 60 to transmit the motion of the cams 7*a* to the pumping pistons 16 which control the intake valves 7, an engine can be obtained, which, while having all the advantages of an operation of the intake valves that is programmable at will, according to times and openings which may vary as a function of the different operating conditions, also has a relatively simple structure and above all a size that is substantially comparable to that of a traditional engine with two camshafts mechanically controlling the intake valves and the exhaust valves. The additional arrangement of all the elements and parts of the hydraulic system for the variable actuation of the intake valves, as well as of the single camshaft 110 and of the rocker arm members 60 which actuate the intake valves, on a single block 190 separate from the head and mounted over it, provides readily apparent advantages from the viewpoint of simplicity of construction and assembly.

The arrangement of the solenoid valves 24 over the block 190, but outside it, allows to assure a cooling of said solenoid valves, even though the operation of the hydraulic system causes heating.

Moreover, the solution described above allows to position the cams 7*a* actuating the intake valves 7 and the cams 70a actuating the exhaust valves 70 relatively close to each other along the shaft 110, without any risk of interference between the parties co-operating therewith (thanks in particular to the use of a hydraulic system to control the intake valves), and maintaining the relative position and the orientation of the intake and exhaust valves, which are necessary for a correct operation of the engine.

It should be noted that, in the case of the solution illustrated in FIGS. 2–4, the camshaft 110 is in contact on one side with the tappets 29 controlling the exhaust valves 70, and substantially on the opposite side with the rollers 62 of the rocker arm members 60 which control the intake valves. The interposition of the hydraulic means between the rocker arm member 60 and the intake valves, as stated, allows to maintain exhaust valves and intake valves in the same positions as in a conventional engine, without particular construction complications.

An additional advantage of the solution described above derives from the fact that the hydraulic device actuating each intake valve is controlled by a rocker arm member which has a roller 62 co-operating with the respective cam 7*a* of the camshaft 110. As stated, said solution allows the additional important advantage, with respect to the known solution illustrated in FIG. 1, of preventing a rubbing contact of the cam against the washer of the pumping piston of the hydraulic device. Said rubbing contact may cause, by friction, transverse thrusts on the washer which, under particular conditions, may compromise the correct sliding of the pumping piston within the respective guide bushing.

Also with reference to FIG. 4, it should be noted that between the actuating piston 21 and the stem of the intake valve 7 is interposed an auxiliary hydraulic tappet 80, which has a first bushing 81, closed at an end, slidably mounted within the bushing 22 which guides the piston 21, and a second bushing 82 slidably mounted within the bushing 81. The first bushing 81 has its closed end in contact with the stem of the intake valve 7. The second bushing 82 has an end in contact with the lower end (with reference to FIG. 4) of the actuating piston 21. A first chamber 83 is defined between the second bushing 82 and the piston 21 and is in communication with a passage 84 formed in the body 190 through holes 84*a* (only one of which is shown in FIG. 4) obtained in the wall of the bushing 22, to feed pressurized oil to said chamber 83. A second chamber 85 is defined between the first bushing 81 and the second bushing 82. A check valve 86, constituted by a ball shutter attached to a return valve 86, controls a passage 86a in a transverse wall of the second bushing 82, to allow the passage of fluid only from the first chamber 81 to the second chamber 82.

During the operation of the engine, the pressurized oil coming from the channel 84 of the lubricating loop arrives into the chamber 83 and from there it passes into the chamber 85 through the check valve 86, thereby compensating for any play in the chain transmitting thrust from the piston 21 to the valve 7.

Figure 5:
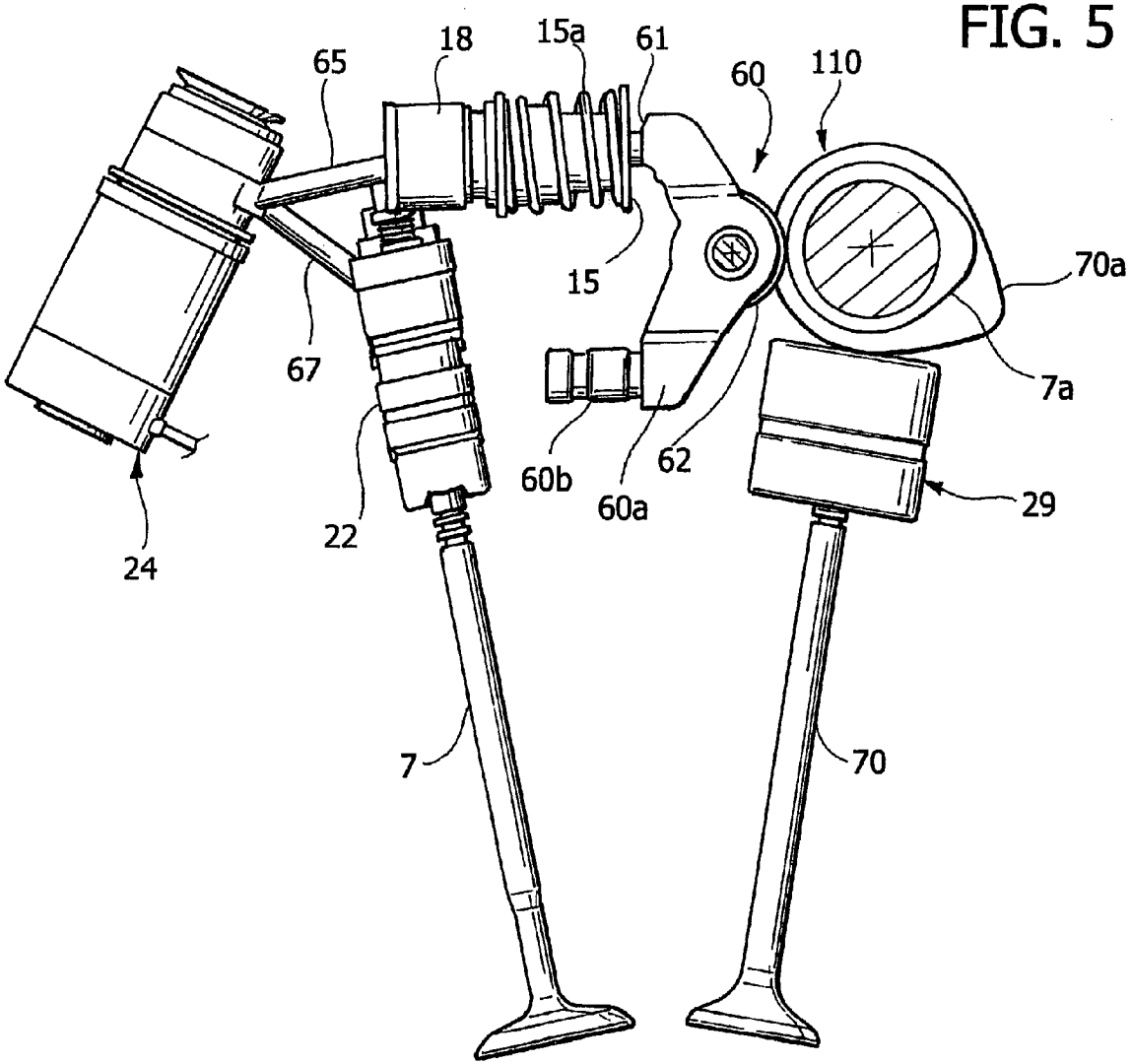
FIG. 5 is a simplified view of a variant, in which for the sake of greater clarity only the various parts of the device for actuating the engine valves are shown, without illustrating the structure that supports them.
Figure 6:
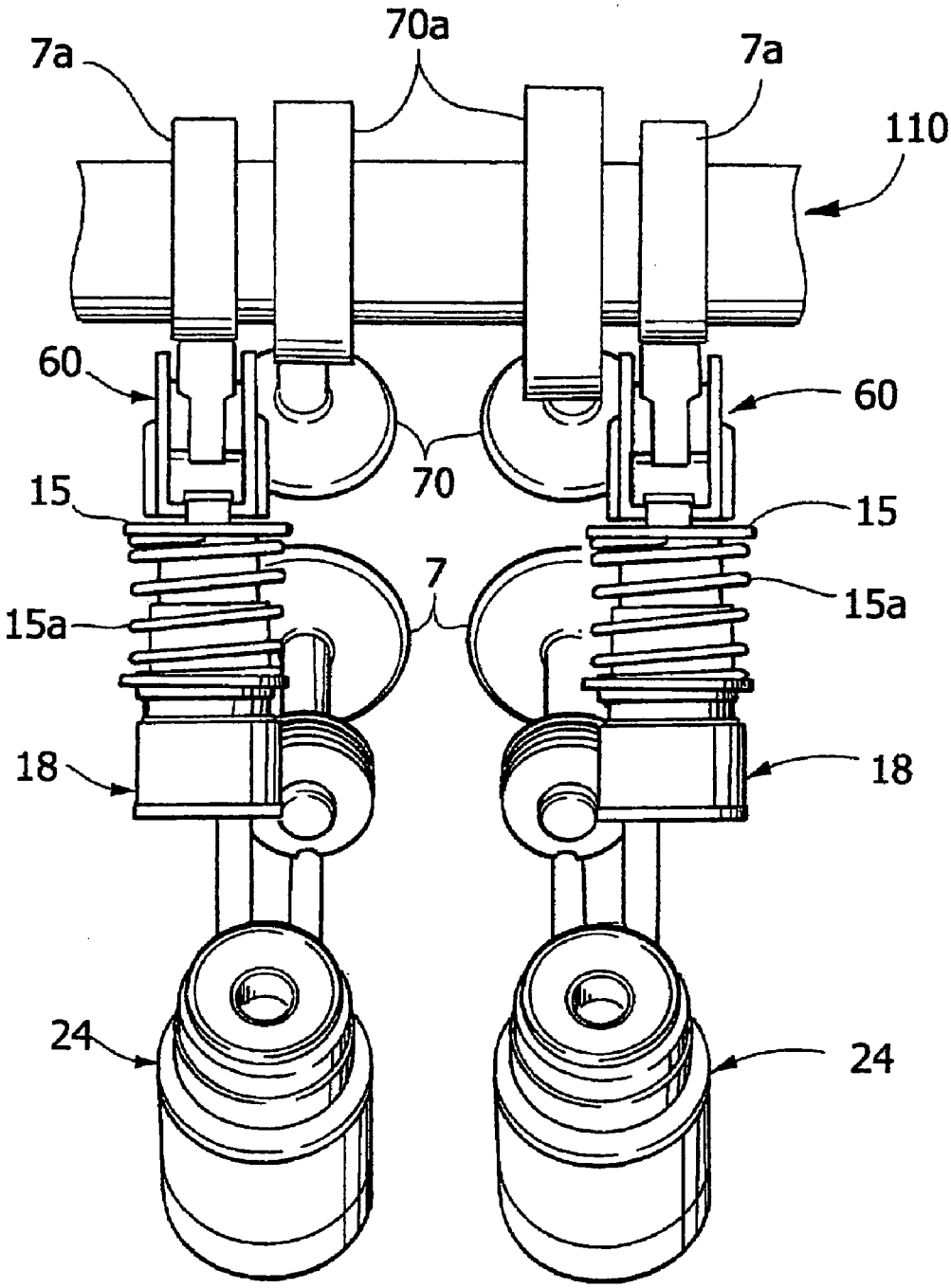
FIG. 6 shows some of the parts of FIG. 5 as they are visible from above.

FIGS. 5, 6 (which are simplified views, showing only the parts of the valve actuation system, without showing the structure of the engine whereon they are borne) refer to a variant which differs from those of FIGS. 2–4 solely because therein each rocker arm member 60 is pivotally engaged to an end 60*a* on the block 190 by means of yielding supports 60*b*, known in themselves, and bears in its intermediate area the rotating roller 62 which co-operates with the cam 7*a*. The other end 61 of the rocker arm member actuates the pumping piston 16. FIG. 6 clearly shows that the cams 7*a* which control the intake valves of each cylinder of the engine and the cams 70*a* which control the exhaust valves of the same cylinder, axially very close to each other in twos. This notwithstanding, the actuating systems of the intake valves and of the exhaust valves do not interfere with each other. This is due first of all to the fact that the intake valves 7 are actuated by a hydraulic system, which allows to transmit motion from the single camshaft 110 to the intake valves 7, leaving said valves in their conventional position (with reference in particular to the inclination of their axis which is optimal for a correct operation of the engine). In this case the camshaft 110 is in contact on one side with the tappets 29 of the exhaust valves, whilst it co-operates with the roller 62 of the rocker arm member 60 actuating the intake valve 7 in a position about 90° relative to the tappets 29.

In the case of the solution of FIGS. 5, 6, moreover, every interference of the cams 7*a* actuating the intake valves with the tappets 29 of the exhaust valves is avoided, in spite of the close position between cams 7*a* and cams 70*a*, because along any outgoing radial direction from the axis of the camshaft 110, the radial dimension of the exhaust cam 70*a* is always greater than the dimension of the cam 7*a*. In other words, the section profile of the cam 7*a* is wholly contained within the profile of the cam 70*a* (see FIG. 5).

FIG. 6 also shows that, like the solution of FIGS. 2–4, use of the hydraulic device for actuating the intake valve allows to maintain the intake valves and the exhaust valves in twos with their axes in a same plane, orthogonal to the axis of the single camshaft, although the respective actuating cams are axially distanced from each other.

Therefore, the cam 7*a* controlling each intake valve 7 and the pumping piston 16 associated thereto are in a plane that is distanced from the plane containing the axis of the respective intake valve and orthogonal to the axis of the shaft 110.

FIGS. 7–10 refer to a second embodiment of the invention, relating to an application to a Diesel engine.

In this case, the cams for controlling the exhaust valves 70*a* actuate said valves mechanically, but by means of rocker arm members 90 mounted oscillating at one end 91 on support 92 (known in themselves) mounted in the structure of the engine, each bearing a freely rotating roller 97 in correspondence with their intermediate portion, said roller co-operating with the respective cam 70*a* and having the opposite end to the end 91, designated by the reference number 93, acting against the stem of the respective exhaust valve 70*a*. The camshaft 110 co-operates with the rocker arm members 60 actuating the intake valves 7 substantially on the side opposite the one co-operating with the rocker arm members 90.

The particular arrangement described above enables to maintain an orientation of the intake valves 7 and of the exhaust valves 70 that is substantially parallel or in any case slightly inclined (at most by an angle of about 2°) relative to the axis of the cylinder, without compromising the complexity of the system and without requiring a large bulk. This arrangement is optimal for the good operation of the Diesel engine.

With reference again to said second embodiment, it comprises a system for venting the air that is formed in the hydraulic device for actuating the intake valves as a result for instance of a prolonged stop of the vehicle with its engine shut down. When the engine is started, the oil from the engine lubrication circuit reaches the pressure chamber C (see FIG. 10) after passing through a first supplementary tank or silo 120, a check valve 121, a second supplementary tank or silo 122, communicating with an accumulator 123 and the passage 23 controlled by the solenoid valve 24. The tanks 120 and 122 respectively have vents 120*a* and 122*a*. It should be noted that a system for venting the air present in the valve actuating device has already been proposed in the Applicant's prior European application EP 1 243 761 B1. However, the system illustrated herein has the novelty of providing a simple capacity (the tank 120) upstream of the check valve 121 (with reference to the direction of the flow of fluid when the engine is started, when the oil from the lubrication loop fills the hydraulic loop controlling the intake valves) with the arrival of the inflow channel 230 into the top part of the tank 120 and the outlet from the tank, obtained in its bottom.

Figure 7:
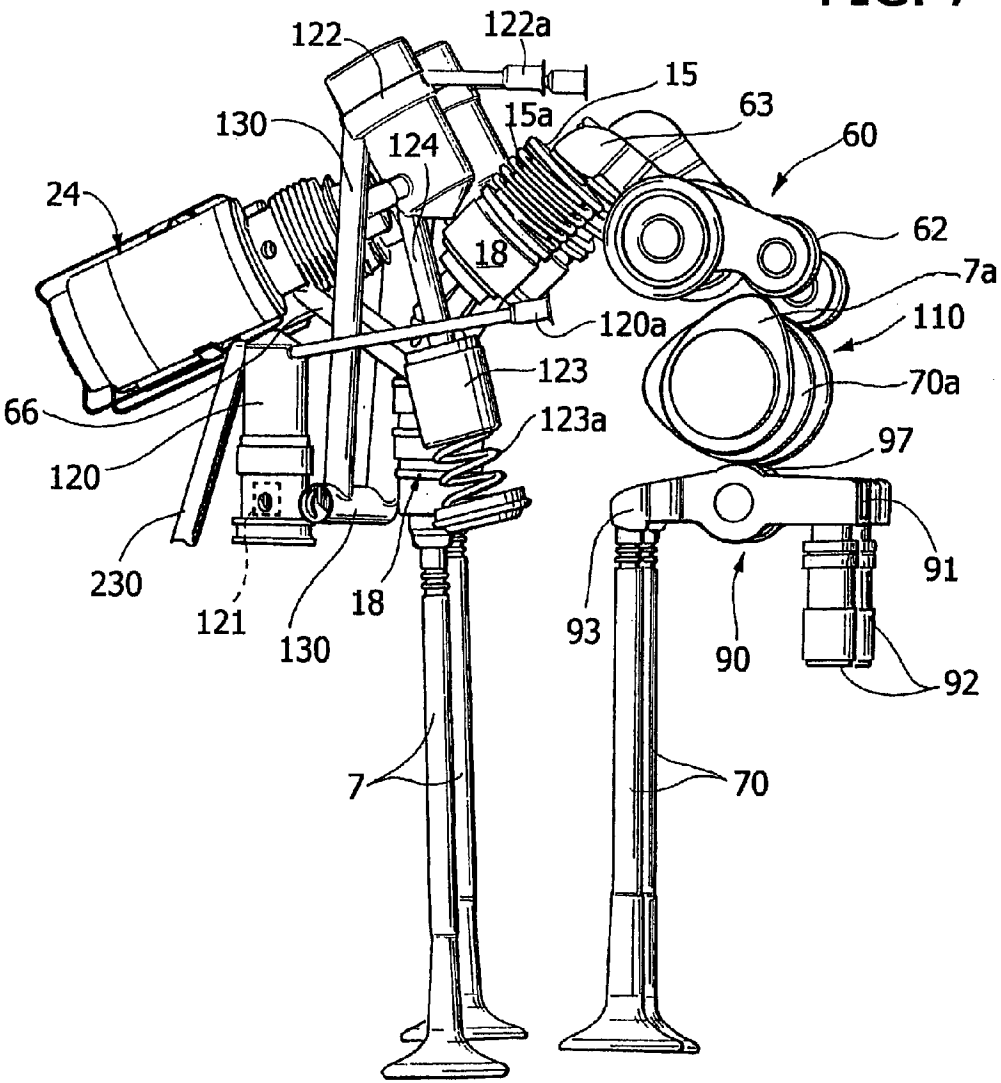
FIG. 7, FIG. 8 and FIG. 9 are a lateral view, a perspective enlarged scale view, and a top view of the parts constituting the valve actuation device, in a second embodiment of the invention, relating to an application to a Diesel engine.
Figure 8:
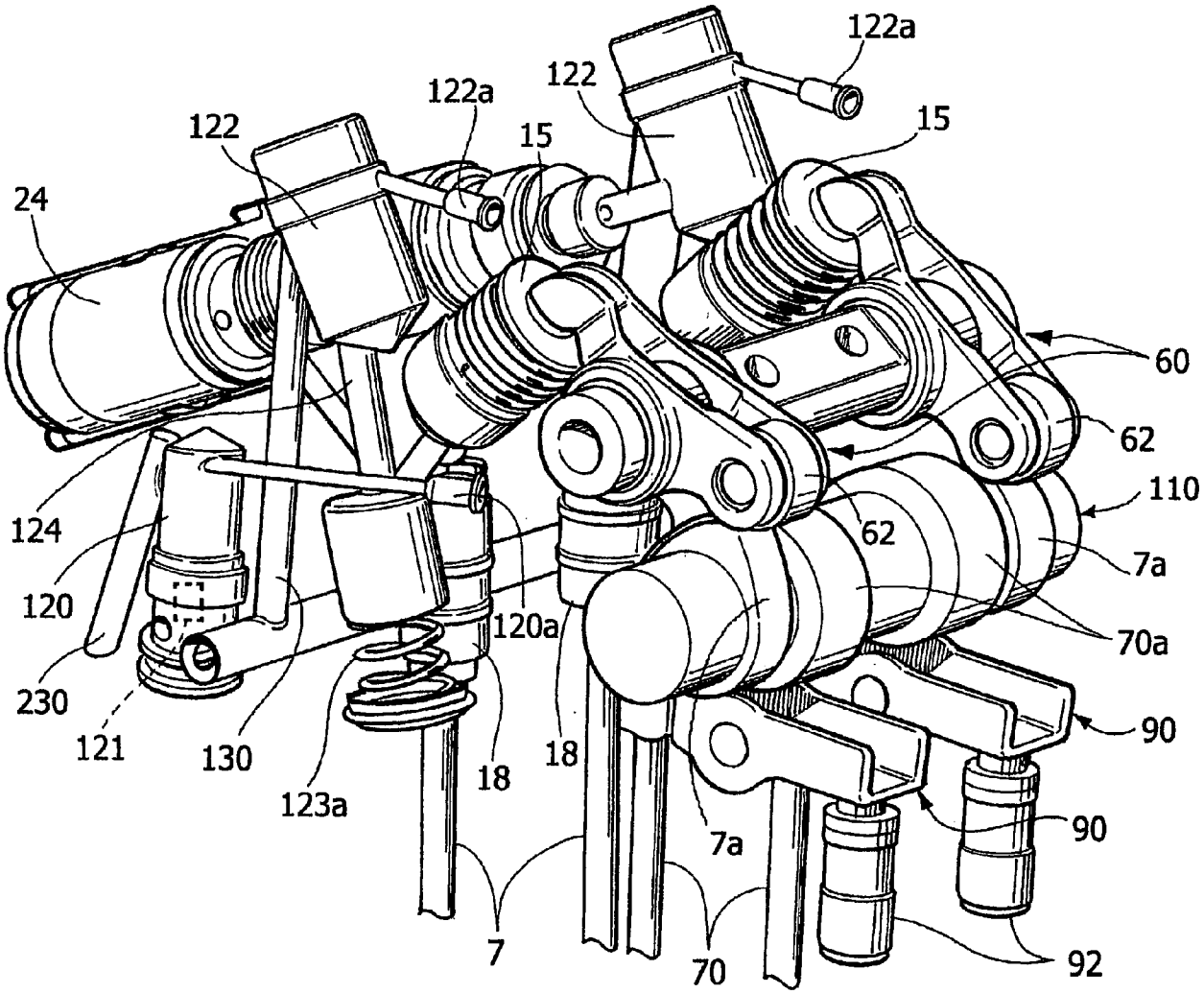
Figure 9:
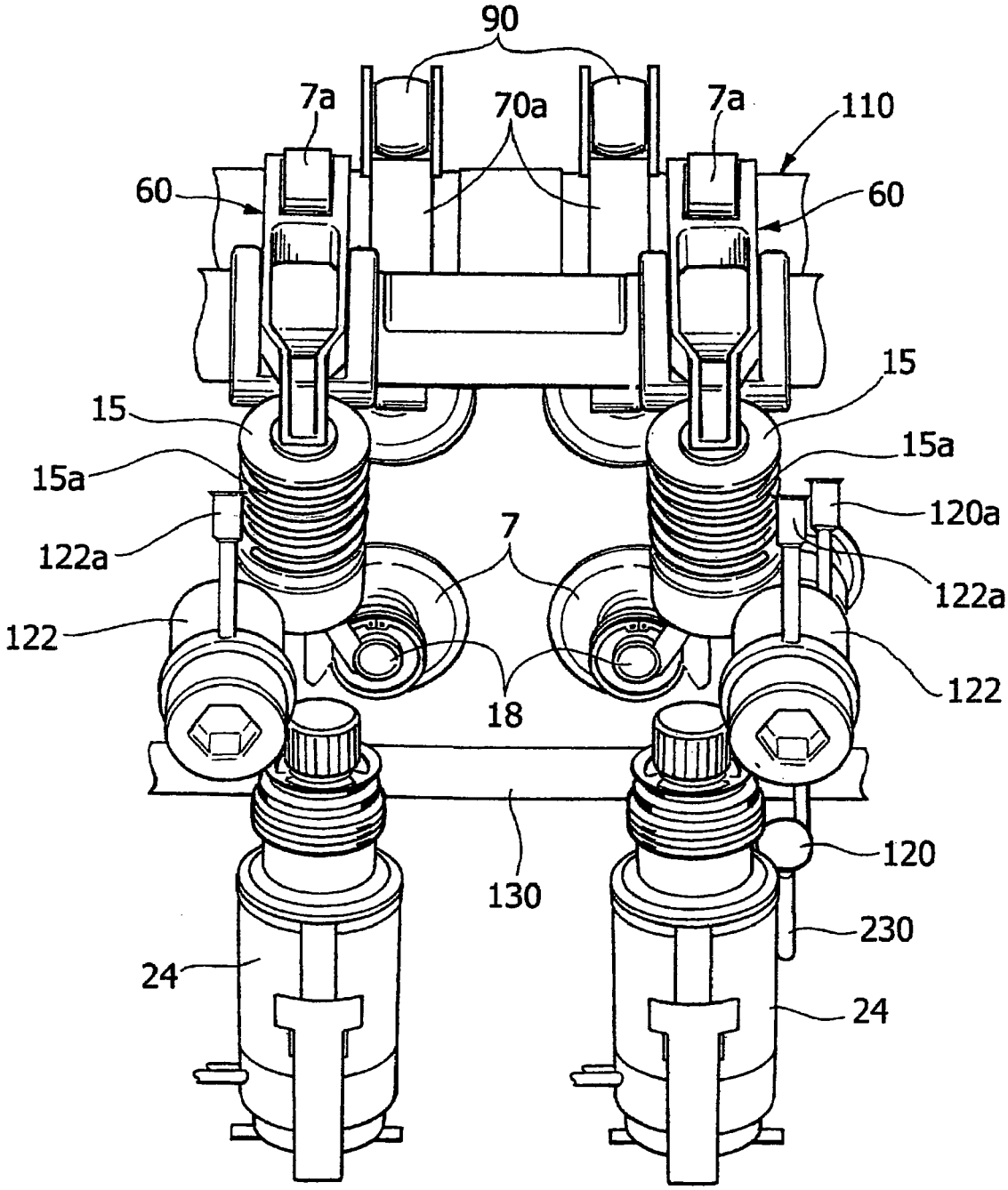
Figure 10:
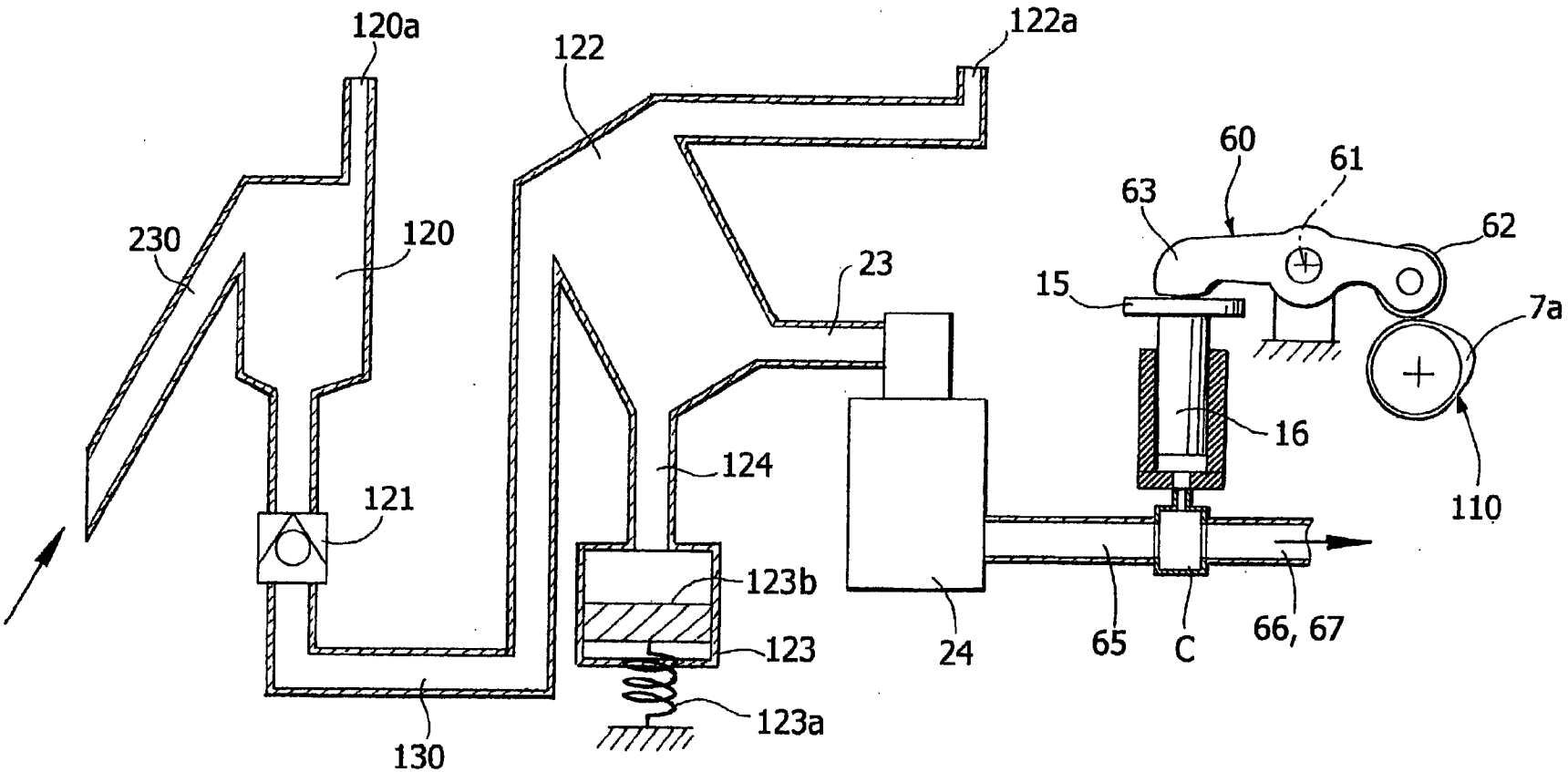
FIG. 10 is a diagram of the device of FIGS. 7–9.

FIG. 10 of the accompanying drawings is a simplified diagram of the hydraulic loop, which shows the manner in which air is vented when the engine is started. The oil from the channel 230 arrives into the top part of the silo 120 venting through the hole 120*a* communicating with the atmosphere. In the practical embodiment illustrated in FIGS. 7–9, said hole 120*a* is obtained in a remote position relative to the silo 120. The oil fed to the silo 120 flows in the direction of a conduit 130 which branches from the bottom of the silo 120 letting the air contained therein vent into the atmosphere. After passing through the non return valve 121, the oil arrives into the second silo 122, where any additional air present therein vents to the atmosphere through an opening 123 (which in the practical embodiments shown in FIGS. 7–9 is also situated in remote position relative to the silo 122. The silo 122 is in communication through a channel 124 with a hydraulic accumulator 123, known in itself, whose capacity is filled displacing a piston 123*b* against the action of a spring 123*a*. From the bottom of the silo 122 branches the channel 23, which can be placed in communication with the pressure chamber C of the device for actuating the intake valve, through the solenoid valve 24.

It should be noted that the arrangement of the silo 120 with the passage 120*a* for venting air to the atmosphere, in an area positioned upstream of the check valve 121 of the hydraulic loop is an innovative element which could also be adopted independently of the arrangement forming the subject of the appended claim 1.

Naturally, without altering the principle of the invention, the construction details and the embodiments may be widely varied relative to what is described and illustrated purely by way of example herein, without thereby departing from the scope of the present invention.

What is claimed is:

1. A multi-cylinder internal combustion engine, comprising:

at least an intake valve and at least an exhaust valve for each cylinder, each provided with respective spring return means which thrust the valve towards a closed position, to control respective intake and exhaust conduits, at least a camshaft, for actuating the intake valves and the exhaust valves of the engine cylinders by means of respective tappets, in which each intake valve is actuated by the respective tappet, against the action of the aforesaid spring return means, by the interposition of hydraulic means including a pressurized fluid chamber, which is faced by a pumping piston connected to the tappet of the intake valve, said pressurized fluid chamber being able to be connected by means of a solenoid valve with an exhaust channel, in order to uncouple the intake valve from the respective tappet and cause the rapid closure of the valve by effect of the respective spring return means, electronic control means for controlling each solenoid valve in such a way as to vary the time and travel of opening of the respective intake valve as a function of one or more operative parameters of the engine, wherein:

both the intake valves and the exhaust valves of the engine are actuated by respective cams carried by a single camshaft of the engine, the exhaust valves of the engine are actuated mechanically by the respective cams of the single camshaft, the intake valves of the engine have the respective pumping pistons actuated by the respective cams of the single camshaft by means of rocker arm members co-operating with said cams of the intake valves, characterized in that pressurized fluid chamber (C) communicates through said solenoid valve (24) with a fluid feeding circuit in which a non return valve (121) is interposed, which allows fluid passage only in the direction of the pressurized fluid chamber (C) and at least a tank (120), vented at its top to the atmosphere located upstream (with reference to the direction of feeding of the fluid) of said check valve (121).

2. An engine as claimed in claim 1, wherein the exhaust valves of the engine are actuated by the respective cams of the single camshaft by means of elements co-operating with said cams on a side of said single camshaft angularly offset relative to the side of said camshaft co-operating with elements for actuating the intake valves.

3. An engine as claimed in claim 1, wherein each cylinder of the engine has at least an intake valve and at least an exhaust valve positioned with their axes in a same plane, orthogonal to the axis of said single camshaft and controlled by respective cams of said single camshaft which are axially distanced from each other.

4. An engine as claimed in claim 3, wherein each pumping piston has the axis contained in a plane that is orthogonal to the axis of the camshaft, which is distanced from said plane containing the axes of the intake valve and of the exhaust valve.

5. An engine as claimed in claim 2, wherein said camshaft co-operates with elements for actuating the intake valves and with elements for actuating the exhaust valves respectively on two sides thereof, mutually offset by an angle of 90°.

6. An engine as claimed in claim 2, wherein said camshaft co-operates with elements for actuating the intake valves and with elements for actuating the exhaust valves respectively on two sides thereof, mutually offset by an angle of about 180°.

7. An engine as claimed in claim 1, wherein the support of the single camshaft, the supports for the aforesaid rocker arm members, the tappets of the intake valves and the elements co-operating with the exhaust valves, as well as the aforesaid hydraulic means for controlling the intake valves and the solenoid valves associated therewith are all borne on a single block mounted on the engine head.

8. An engine as claimed in claim 1, wherein for each outgoing radial direction from the axis of the single camshaft, the radial dimension of the cam actuating the intake valve is smaller than the radial dimension of the cam actuating the exhaust valve.

9. An engine as claimed in claim 1, wherein the aforesaid hydraulic means comprise a piston for actuating each intake valve, slidably mounted in a guide bushing, said actuating piston facing a variable volume chamber communicating with the pressurized fluid chamber both through first communication means controlled by a check valve which allows only the passage of the fluid from the pressurized fluid chamber to the variable volume chamber, and through second communication means which allow the passage between the two chambers in both directions;

said hydraulic means further comprising hydraulic braking means able to cause a narrowing of said second communication means in the final phase of closure of the engine valve.

10. An engine as claimed in claim 9, wherein between actuating piston of each intake valve and the stem of the intake valve is interposed a hydraulic tappet.

11. An engine as claimed in claim 10, wherein said hydraulic tapped comprises:

a first outer bushing slidably mounted within the guide bushing of the actuating piston and having an end wall in contact with an end of the stem of the intake valve, a second inner bushing slidably mounted within said first outer bushing and having an end in contact with a corresponding end of said actuating piston, a first chamber defined between said bushing and said actuating piston, which is in communication with a passage for feeding the pressurized fluid to said first chamber, a second chamber defined between said first bushing and said second bushing, and a non return valve which controls a passage in a wall of said second bushing to allow the passage of fluid only from said first chamber to said second chamber of said auxiliary hydraulic tappet.

12. An engine as claimed in claim 1, wherein said tank has an inflow channel which ends at its summit and an outflow channel which starts from its bottom.

13. An engine as claimed in claim 1, wherein the cams which actuate the exhaust valves co-operate with tappets that are directly associated to the exhaust valves.

14. An engine as claimed in claim 1, wherein the cams that actuate the exhaust valves actuate said valves by means of rocker arm members mounted oscillating on the engine structure.

15. An engine as claimed in claim 1, wherein said rocker arm members interposed between the cams for actuating the intake valves and the pumping pistons associated with the various intake valves are pivotally engaged centrally and have an end which bears a freely rotating roller co-operating with the respective cam and the opposite end which controls the respective pumping piston.

16. An engine as claimed in claim 1, wherein said rocker arm members interposed between the cams for actuating the intake valves and the pumping pistons associated with the various intake valves have an end which is mounted oscillating on the structure of the engine, an intermediate position that supports in freely rotating fashion a roller co-operating with the respective cam and the opposite end which co-operates with the respective pumping piston.

* * * * *